US011488529B2

(12) United States Patent
Hwang et al.

(10) Patent No.: US 11,488,529 B2
(45) Date of Patent: Nov. 1, 2022

(54) DISPLAY COMPENSATION USING CURRENT SENSING ACROSS A DIODE WITHOUT USER DETECTION

(71) Applicant: Apple Inc., Cupertino, CA (US)

(72) Inventors: Injae Hwang, Cupertino, CA (US); Jesun Kim, Cupertino, CA (US); Hyunwoo Nho, Palo Alto, CA (US); Jie Won Ryu, Santa Clara, CA (US); Hyunsoo Kim, Mountain View, CA (US); Junhua Tan, Saratoga, CA (US); Myungjoon Choi, Sunnyvale, CA (US); Rebecca Park, Stanford, CA (US); Shiping Shen, Cupertino, CA (US); Sun-Il Chang, San Jose, CA (US); Shengkui Gao, San Jose, CA (US); Kingsuk Brahma, Mountain View, CA (US); Jesse Aaron Richmond, San Francisco, CA (US); Changki Min, San Jose, CA (US); Yifan Zhang, San Carlos, CA (US); Jiye Lee, Mountain View, CA (US); Chaohao Wang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 65 days.

(21) Appl. No.: 16/849,712

(22) Filed: Apr. 15, 2020

(65) Prior Publication Data

US 2020/0365082 A1 Nov. 19, 2020

Related U.S. Application Data

(60) Provisional application No. 62/849,027, filed on May 16, 2019.

(51) Int. Cl.
*G09G 3/3233* (2016.01)
*G09G 3/00* (2006.01)

(52) U.S. Cl.
CPC ..... *G09G 3/3233* (2013.01); *G09G 3/006* (2013.01); *G09G 2320/0626* (2013.01); *G09G 2320/0693* (2013.01)

(58) Field of Classification Search
CPC .. G09G 3/3233; G09G 3/3241; G09G 3/3275; G09G 3/3258; G09G 3/3291; G09G 3/006
See application file for complete search history.

(56) References Cited

U.S. PATENT DOCUMENTS 9,634,038 B2 4/2017 Kwon et al.
9,978,312 B2 5/2018 Yang et al.
(Continued)

*Primary Examiner* — William Boddie
(74) *Attorney, Agent, or Firm* — Fletcher Yoder, P.C.

(57) ABSTRACT

A current-voltage (IV) relationship of a pixel having a diode is initially determined. A first voltage is determined that does not cause the diode to emit light, and a first current across the diode is sensed by applying the first voltage. A predetermined current is determined based on the first voltage and the IV relationship. A ratio is determined based on the first current, a target current, and the predetermined current. A ratio voltage is determined by applying the ratio to a predetermined target voltage. If the first current is less than the predetermined current, then the ratio voltage is applied to supply a target current to the diode. If the first current is greater than the predetermined current, then a second voltage is determined by averaging the first test voltage and the ratio voltage, and the second voltage is applied to supply the target current to the diode.

20 Claims, 10 Drawing Sheets

(56) References Cited

U.S. PATENT DOCUMENTS

| | | | | |
|---|---|---|---|---|
| 2011/0254871 | A1* | 10/2011 | Yoo | G09G 3/3233 345/690 |
| 2011/0279014 | A1 | 11/2011 | Winters et al. | |
| 2014/0168194 | A1* | 6/2014 | Kong | H01L 29/78645 345/212 |
| 2016/0063923 | A1* | 3/2016 | Yang | G09G 3/3258 345/211 |
| 2016/0267844 | A1* | 9/2016 | Senda | G09G 3/3291 |
| 2017/0032743 | A1* | 2/2017 | Lee | G09G 3/3233 |
| 2018/0254009 | A1* | 9/2018 | Li | G09G 3/3241 |
| 2019/0333448 | A1 | 10/2019 | Kim et al. | |
| 2020/0272406 | A1* | 8/2020 | DeMik | G06F 3/1462 |
| 2020/0312244 | A1* | 10/2020 | Yang | G09G 3/3275 |
| 2020/0335040 | A1* | 10/2020 | Nho | G09G 3/3258 |

* cited by examiner

DISPLAY COMPENSATION USING CURRENT SENSING ACROSS A DIODE WITHOUT USER DETECTION

CROSS REFERENCE TO RELATED APPLICATIONS

This application claims priority from and the benefit of U.S. Provisional Application Ser. No. 62/849,027, entitled "DISPLAY COMPENSATION USING CURRENT SENSING ACROSS A DIODE WITHOUT USER DETECTION," filed May 16, 2019, which is hereby incorporated by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relate to devices and methods for increased determination of the performance of certain electronic display devices including, for example, light emitting diode (LED) displays, such as organic light emitting diode (OLED) displays, active matrix organic light emitting diode (AMOLED) displays, or micro LED (μLED) displays. Under certain conditions, non-uniformity of a display induced by process non-uniformity temperature gradients, or other factors across the display should be compensated for to increase performance of a display (e.g., reduce visible anomalies). The non-uniformity of pixels in a display may vary between devices of the same type (e.g., two similar phones, tablets, wearable devices, or the like), vary over time and usage (e.g., due to aging and/or degradation of the pixels or other components of the display), and/or vary with respect to temperatures, as well as in response to additional factors.

To improve display panel uniformity, compensation techniques related to adaptive correction of the display may be employed. For example, as pixel response (e.g., luminance and/or color) can vary due to component processing, temperature, usage, aging, and the like, in one embodiment, to compensate for non-uniform pixel response, a property of the pixel (e.g., a current or a voltage) may be measured (e.g., sensed via a sensing operation) and compared to a target value that is, for example, stored in a lookup table or the like, to generate a correction value to be applied to correct pixel illuminations to match a desired gray level. In this manner, modified data values may be transmitted to the display to generate compensated image data (e.g., image data that accurately reflects the intended image to be displayed by adjusting for non-uniform pixel responses).

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
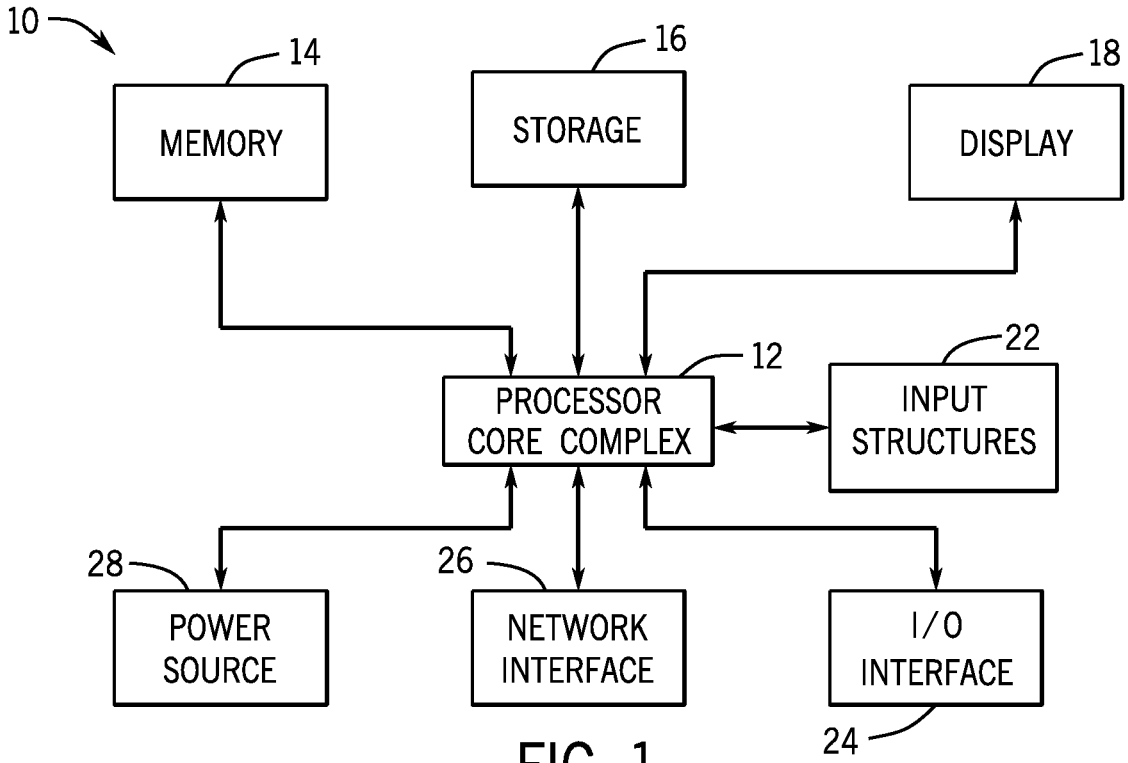
FIG. 1 is a schematic block diagram of an electronic device that performs display sensing and compensation, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

Display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. However, compensation of these variations may hinge on proper sensing of differences in the images displayed on the pixels of the display. Accordingly, the techniques and systems described below may be utilized to enhance the compensation of operational variations across the display.

Figure 2:
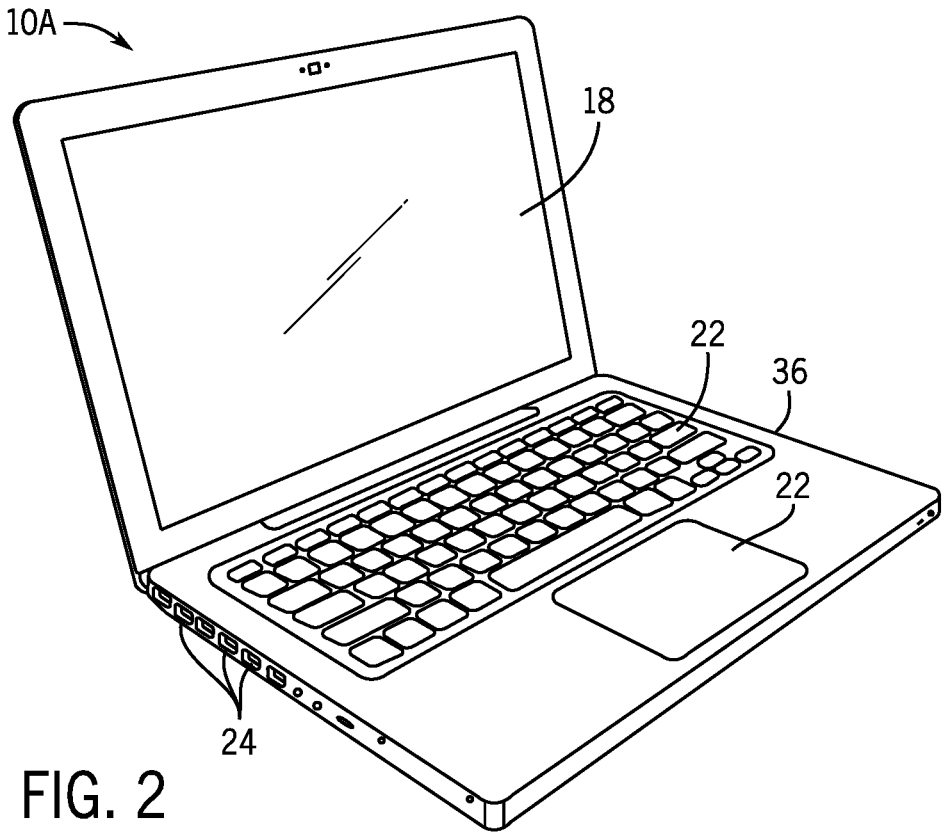
FIG. 2 is a perspective view of a notebook computer representing an embodiment of the electronic device of FIG. 1.
Figure 4:
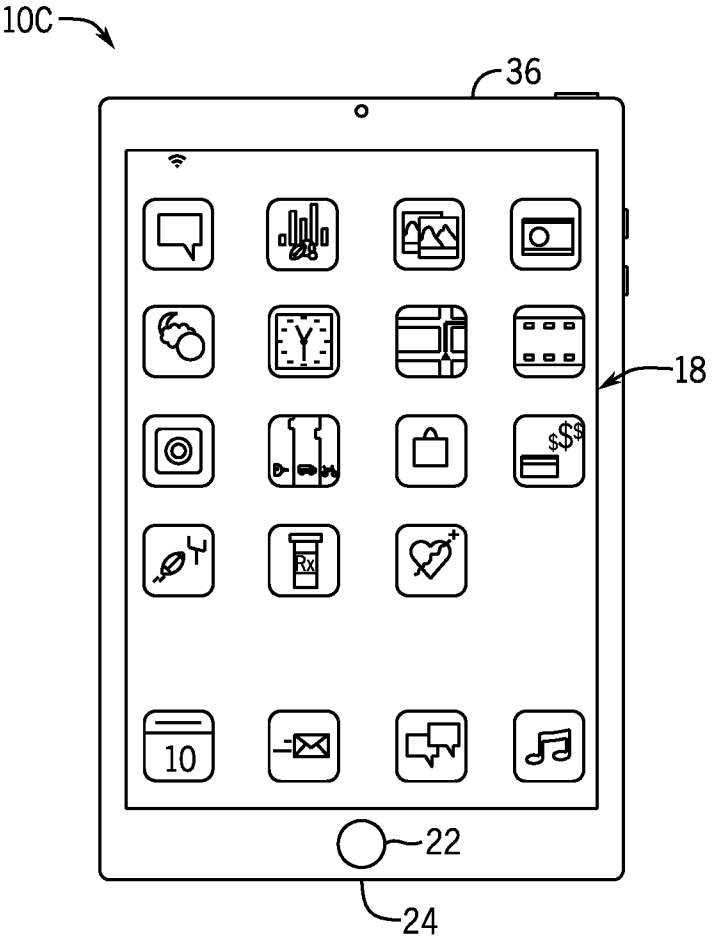
FIG. 4 is a front view of another hand-held device representing another embodiment of the electronic device of FIG. 1.
Figure 3:
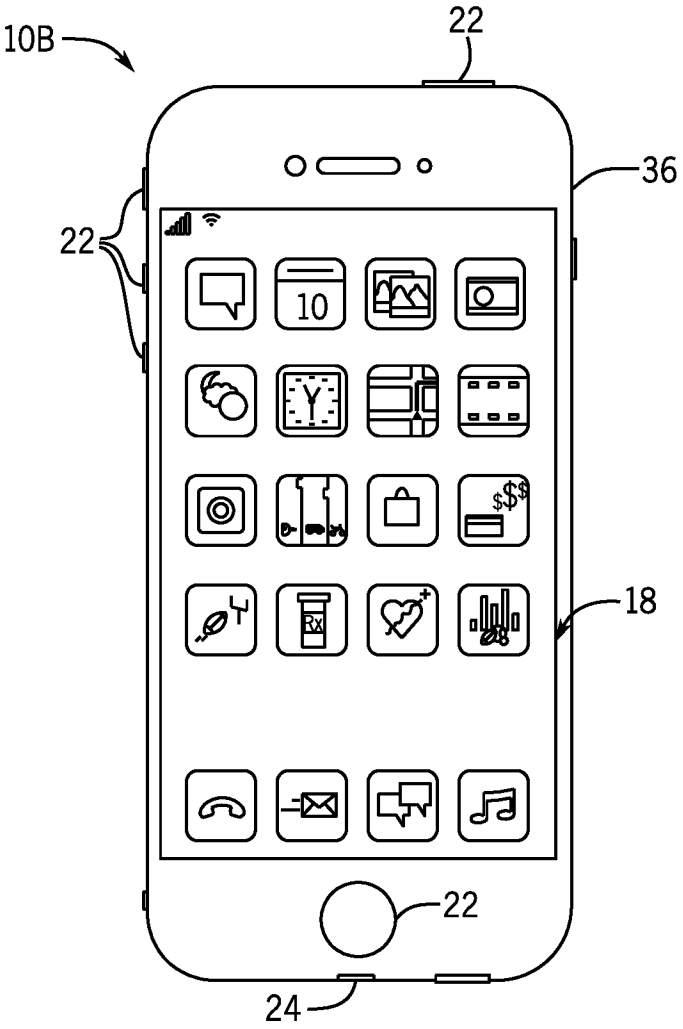
FIG. 3 is a front view of a hand-held device representing another embodiment of the electronic device of FIG. 1.
Figure 5:
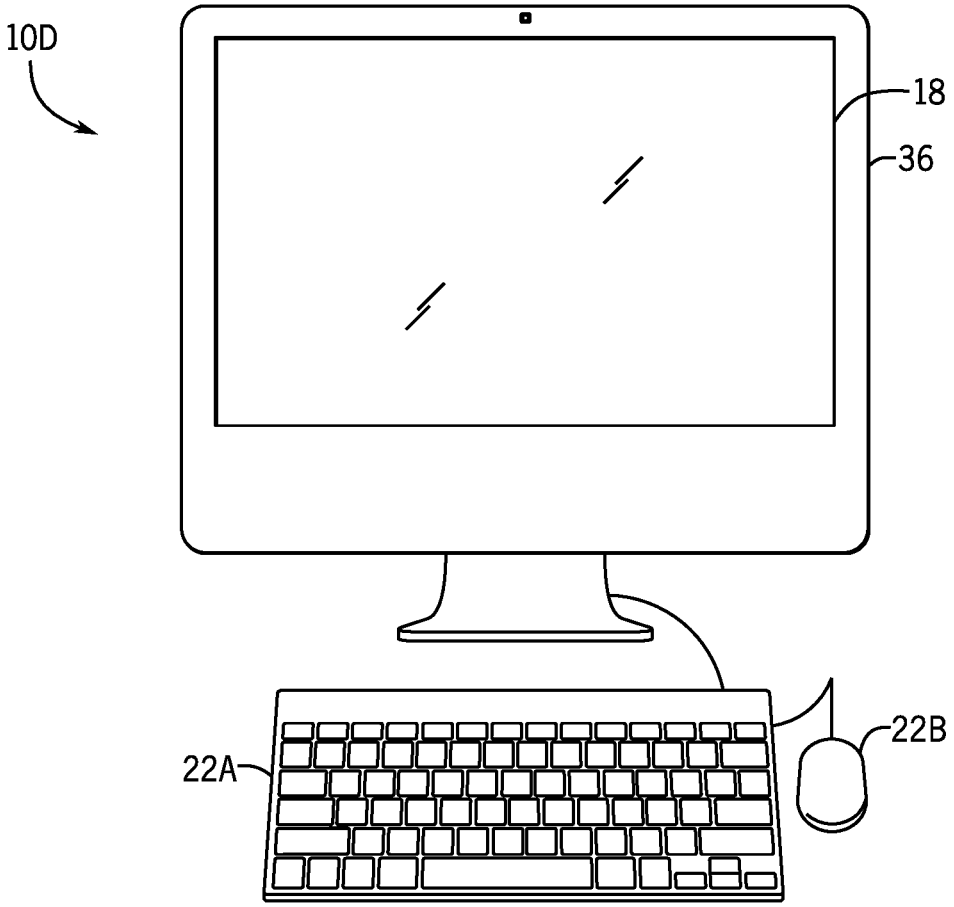
FIG. 5 is a front view of a desktop computer representing another embodiment of the electronic device of FIG. 1.
Figure 6:
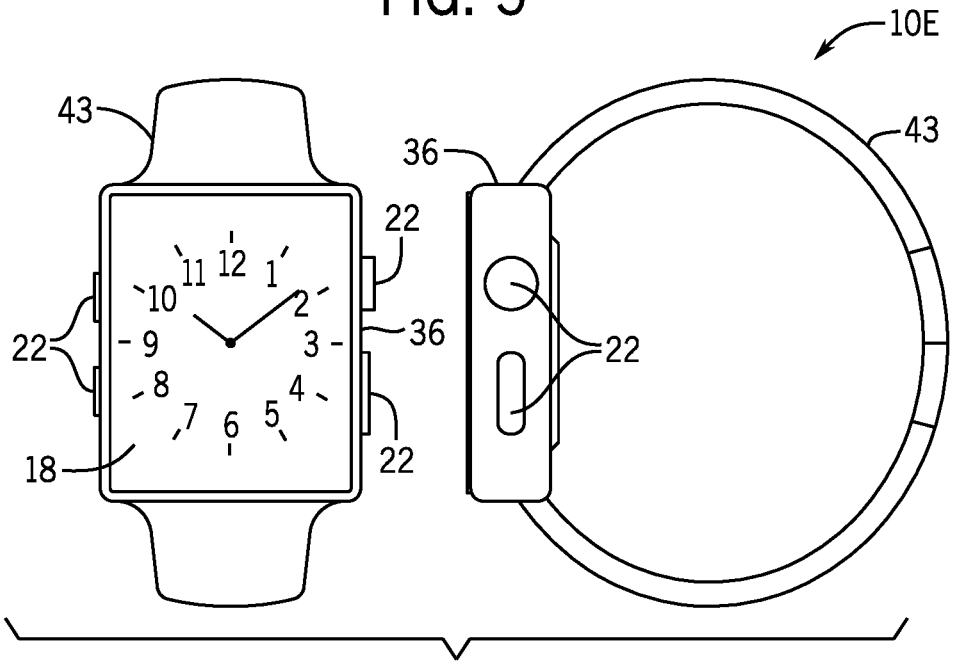
FIG. 6 is a front view and side view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, a micro-LED display, a micro-OLED type display, or a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 or the electronic display 18 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
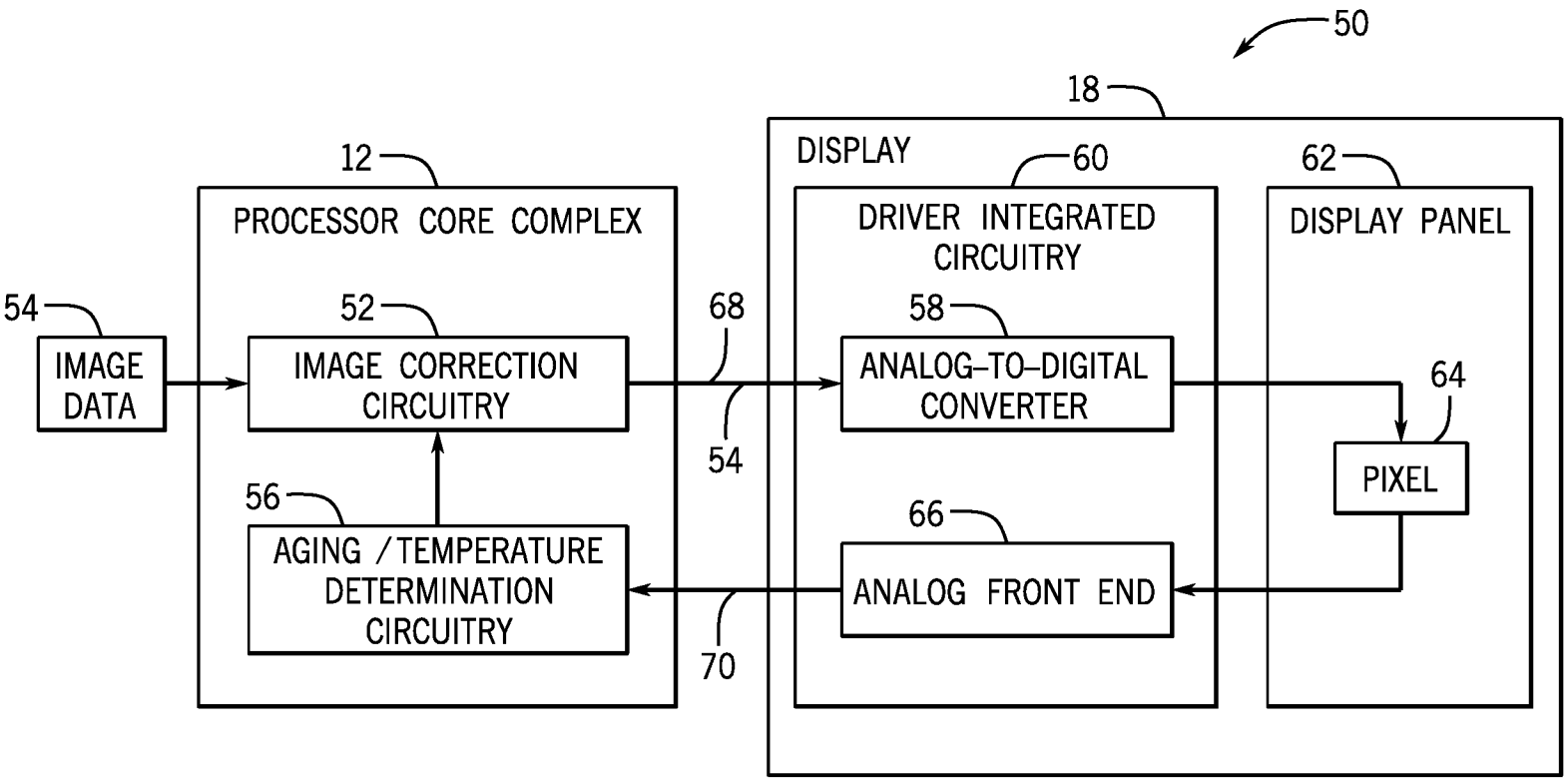
FIG. 7 is a block diagram of a system for display sensing and compensation of the electronic device of FIG. 1, according to an embodiment of the present disclosure.

FIG. 7 is a block diagram of a system 50 for display sensing and compensation of the electronic device 10 of FIG. 1, according to an embodiment of the present disclosure. The system 50 includes the processor core complex 12, which includes image correction circuitry 52. The image correction circuitry 52 may receive image data 54, and compensate for non-uniformity of the display 18 based on and induced by process non-uniformity temperature gradients, aging of the display 18, and/or other factors across the display 18 to increase performance of the display 18 (e.g., by reducing visible anomalies). The non-uniformity of pixels in the display 18 may vary between devices of the same type (e.g., two similar phones, tablets, wearable devices, or the like), over time and usage (e.g., due to aging and/or degradation of the pixels or other components of the display 18), and/or with respect to temperatures, as well as in response to additional factors.

As illustrated, the system 50 includes aging/temperature determination circuitry 56 that may determine or facilitate determining the non-uniformity of the pixels in the display 18 due to, for example, aging and/or degradation of the pixels or other components of the display 18. The aging/temperature determination circuitry 56 that may also determine or facilitate determining the non-uniformity of the pixels in the display 18 due to, for example, temperature. The variation in temperature may be due to changes in ambient temperature and/or a proximity of the pixels to a heat source (e.g., a fingertip of a user). In some cases, the pixels may lay on top of or be in otherwise close proximity to other components of an electronic device that may be more densely packed with components due to the relatively small size of the electronic device (e.g., handheld, mobile, or portable electronic devices such as 10B, 10C, 10E). As such, the variation in temperature may be due to operation of the components that the pixels are laying on top of or are in close proximity to.

The image correction circuitry 52 may send the image data 54 (for which the non-uniformity of the pixels in the display 18 have or have not been compensated for by the image correction circuitry 52) to analog-to-digital converter 58 of a driver-integrated circuit 60 of the display 18. The analog-to-digital conversion converter 58 may digitize the image data 54 when it is in an analog format. The driver-integrated circuit 60 may send signals across gate lines to cause a row of pixels of a display panel 62, including pixel 64, to become activated and programmable, at which point the driver-integrated circuit 60 may transmit the image data 54 across data lines to program the pixels, including the pixel 64, to display a particular gray level (e.g., individual pixel brightness). By supplying different pixels of different colors with the image data 54 to display different gray levels, full-color images may be programmed into the pixels. The driver-integrated circuit 60 may also include a sensing analog front end (AFE) 66 to perform analog sensing of the response of the pixels to data input (e.g., the image data 54) to the pixels.

The processor core complex 12 may also send sense control signals 68 to cause the display 18 to perform display panel sensing. In response, the display 18 may send display sense feedback 70 that represents digital information relating to the operational variations of the display 18. The display sense feedback 70 may be input to the aging/temperature determination circuitry 56, and take any suitable form. Output of the aging/temperature determination circuitry 56 may take any suitable form and be converted by the image correction circuitry 52 into a compensation value that, when applied to the image data 54, appropriately compensates for non-uniformity of the display 18. This may result in greater fidelity of the image data 54, reducing or eliminating visual artifacts that would otherwise occur due to the operational variations of the display 18. In some embodiments, the processor core complex 12 may be part of the driver-integrated circuit 60, and as such, be part of the display 18.

Figure 8:
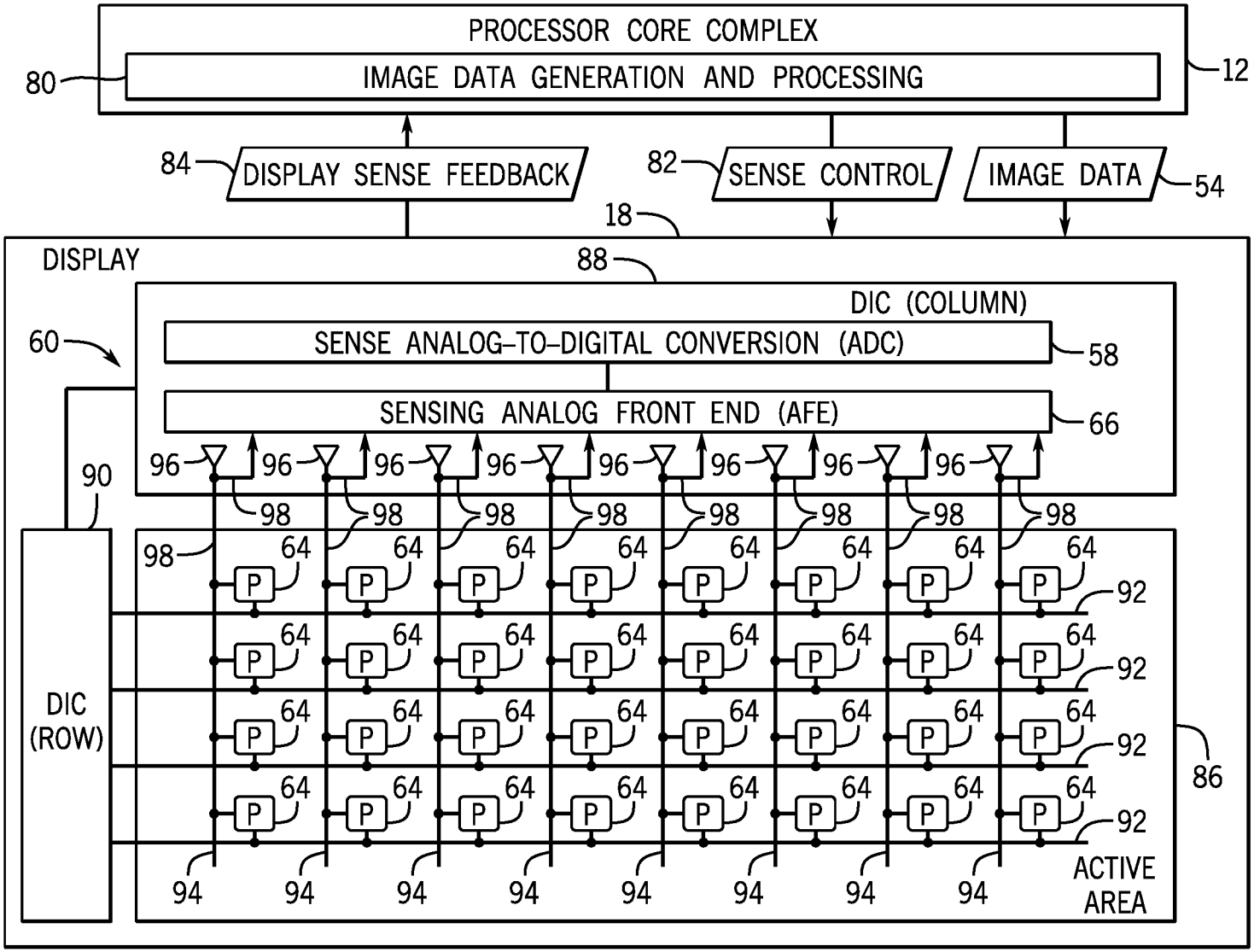
FIG. 8 is a schematic diagram of the system for display sensing and compensation of FIG. 7, according to an embodiment of the present disclosure.

FIG. 8 is a schematic diagram of the system 50 for display sensing and compensation of FIG. 7, according to an embodiment of the present disclosure. The processor core complex 12 may include image data generation and processing circuitry 80 to generate the image data 54 for display by the electronic display 18. The image data generation and processing circuitry 80 represents various circuitry and processing that may be employed by the processor core complex 12 to generate the image data 54 and control the electronic display 18. As such, the image data generation and processing circuitry 80 may include, for example, the image correction circuitry 52 and/or the aging/temperature determination circuitry 56 of FIG. 7. In some embodiments, the image data generation and processing circuitry 80 may include a graphics processing unit, a display pipeline, or the like, to facilitate control of operation of the electronic display 18. The image data generation and processing circuitry 80 may include a processor and memory such that the processor of the image data generation and processing circuitry 80 may execute instructions and/or process data stored in memory of the image data generation and processing circuitry 80 to control operation of the electronic display 18.

To compensate for operational variations of the electronic display 18 due to, for example, temperature variation or aging of the display 18, the processor core complex 12 may provide sense control signals 82 to cause the electronic display 18 to perform display panel sensing and generate display sense feedback 84. The display sense feedback 84 represents digital information relating to the operational variations of the electronic display 18. The display sense feedback 84 may take any suitable form, and may be converted by the image data generation and processing circuitry 80 into a compensation value that, when applied to the image data 54, appropriately compensates for the conditions of the electronic display 18 in the image data 54. This may result in greater fidelity of the image data 54, reducing or eliminating visual artifacts that would otherwise occur due to the operational variations of the electronic display 18.

The electronic display 18 includes an active area 86 with an array of pixels 64. The pixels 64 are schematically shown distributed substantially equally apart and of the same size, but in an actual implementation, pixels of different colors may have different spatial relationships to one another and may have different sizes. In one example, each pixel 64 may have a red-green-blue (RGB) format that includes red, green, and blue pixels or sub-pixels. In another example, the pixels 64 may take a red-green-blue-green (RGBG) format in a diamond pattern. The pixels 64 are controlled by the driver-integrated circuit 60, which may be a single module or may be made up of separate modules, such as a column or source driver-integrated circuit 88 and a row or gate driver-integrated circuit 90. The driver-integrated circuit 60 (e.g., the row driver-integrated circuit 90) may send signals across gate lines 92 (e.g., using gate drivers) to cause a row of pixels 64 to become activated and programmable, at which point the driver-integrated circuit 60 (e.g., the column driver-integrated circuit 88) may transmit image data signals across data lines 94 to program the pixels 64 to display a particular gray level (e.g., individual pixel brightness). By supplying different pixels 64 of different colors with image data 54 to display different gray levels, full-color images may be programmed into the pixels 64. The image data 54 may be driven to an active row of pixels 64 via source drivers 96, which may also be referred to as column drivers.

Regardless of the particular arrangement and layout of the pixels 64, each pixel 64 may be sensitive to changes on the active area 86 of the electronic display 18, such as variations and temperature of the active area 86, as well as the overall age of the pixel 64. Indeed, when each pixel 64 is a light emitting diode (LED), it may gradually emit less light over time. This effect is referred to as aging, and takes place over a slower time period than the effect of temperature on the pixel 64 of the electronic display 18.

As described above, the electronic display 18 may display image frames through control of the luminance of the pixels 64 based on the received image data 54. When a pixel 64 is activated (e.g., via a gate activation signal across a gate line 92 activating a row of pixels 64), luminance of a display pixel 64 may be adjusted by image data 54 received via a data line 94 coupled to the pixel 64. Thus, as depicted, each pixel 64 may be located at an intersection of a gate line 92 (e.g., a scan line) and a data line 94 (e.g., a source line). Based on the received image data 54, the luminance of a display pixel 64 may be adjusted using electrical power supplied from a power source 28, for example, via power a supply lines coupled to the pixel 64.

In some embodiments, to facilitate displaying an image frame, a timing controller may determine and transmit timing data to a gate driver of the row driver-integrated circuit 90 based on the image data 54. For example, in the depicted embodiment, the timing controller may be included in the column driver-integrated circuit 88. The column driver-integrated circuit 88 may receive image data 54 that indicates desired luminance of one or more display pixels 64 for displaying an image frame of the image data 54, analyze the image data 54 to determine the timing data based on the display pixels 64 that the image data 54 corresponds to, and transmit the timing data to the gate driver of the row driver-integrated circuit 90. Based on the timing data, the gate driver may then transmit gate activation signals to activate a row of display pixels 64 via a gate line 92.

As illustrated, the image data generation and processing circuitry 80 may be externally coupled to the electronic display 18. That is, the image data generation and processing circuitry 80 may be included in the processor core complex 12, which is separate from but communicatively coupled to the electronic display 18 and the driver-integrated circuit 60 (including the column driver-integrated circuit 88 and the row driver-integrated circuit 90) of the electronic display 18. The image data generation and processing circuitry 80 may be modular from the display 18 and conveniently updated and/or replaced (e.g., compared to if it were integrated in the display 18). Moreover, in cases where the system 50 is part of a component-dense electronic device 10 (such as the handheld devices 10B-C or the wearable electronic device 10E) that would place a display-integrated image data generation and processing circuitry in close proximity to (e.g., underlying) the pixels 64, heat generated from the image data generation and processing circuitry 80 may combine or intermix with the heat generated from the pixels 64, which may result in inaccurate temperature measurements of the pixels 64. However, in other embodiments, the image data generation and processing circuitry 80 may be part of the display 18.

Display panel sensing may be used to obtain the display sense feedback 84, which may enable the processor core complex 12 to generate compensated image data 54 to negate the effects of temperature, aging, and other variations of the active area 86. The driver-integrated circuit 60 (e.g., the column driver-integrated circuit 88) may include the sensing analog front end (AFE) 66 to perform analog sensing of the response of pixels 64 to test data (e.g., test image data) or user data (e.g., user image data). It should be understood that further references to test data or test image data in the present disclosure include test data and/or user data. The analog signal may be digitized by sensing analog-to-digital conversion circuitry (ADC) 58.

For example, to perform display panel sensing, the electronic display 18 may program one of the pixels 64 with test data (e.g., having a particular reference voltage or reference current). The sensing analog front end 66 then senses (e.g., measures, receives, etc.) at least one value (e.g., voltage, current, etc.) along sense line 98 connected to the pixel 64 that is being tested. Here, the data lines 94 are shown to act as extensions of the sense lines 98 of the electronic display 18. In other embodiments, however, the display active area 86 may include other dedicated sense lines 98 or other lines of the display 18 (e.g., such as the gate or scan lines 92) may be used as sense lines 98 instead of the data lines 94. In some embodiments, other pixels 64 that have not been programmed with test data may be also sensed at the same time a pixel 64 that has been programmed with test data is sensed. Indeed, by sensing a reference signal on a sense line 98 when a pixel 64 on that sense line 98 has not been programmed with test data, a common-mode noise reference value may be obtained. This reference signal can be removed from the signal from the test pixel 64 that has been programmed with test data to reduce or eliminate common mode noise.

The analog signal may be digitized by the sensing analog-to-digital conversion circuitry 58. The sensing analog front end 66 and the sensing analog-to-digital conversion circuitry 58 may operate, in effect, as a single unit. The driver-integrated circuit 60 (e.g., the column driver-integrated circuit 88) may also perform additional digital operations to generate the display feedback 84, such as digital filtering, adding, or subtracting, or such processing may be performed by the processor core complex 12.

Figure 9:
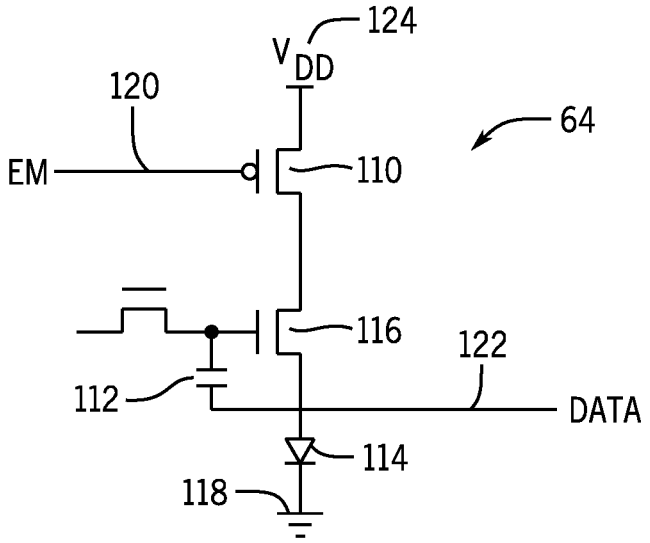
FIG. 9 is a circuit diagram of a display pixel of the electronic display of the electronic device of FIG. 1, according to embodiments of the present disclosure.

FIG. 9 is a circuit diagram of a display pixel 64 of the electronic display 18 of the electronic device 10 of FIG. 1, according to embodiments of the present disclosure. Each pixel 64 may include a circuit-switching thin-film transistor (TFT) 110, a storage capacitor 112, a diode 114 (e.g., an OLED), and a driver TFT 116 (whereby each of the storage capacitor 112 and the diode 114 may be coupled to a ground or any suitable ground supply voltage 118). However, variations may be utilized in place of the illustrated pixel 64. For example, FIG. 9 illustrates the circuit-switching TFT 110 as a p-channel metal-oxide-semiconductor (PMOS) TFT. However, in some embodiments, the circuit-switching TFT 110 may be an n-channel metal-oxide-semiconductor (NMOS) TFT. To facilitate adjusting luminance, the driver TFT 116 and the circuit-switching TFT 110 may each serve as a switching device that is controllably turned on and off by voltage applied to their respective gates. In the depicted embodiment, the gate of the circuit-switching TFT 110 is electrically coupled to a gate line 120. Accordingly, when a gate activation signal received from the gate line 120 is below a threshold voltage, the circuit-switching TFT 110 may turn on, thereby activating the pixel 64 and charging the storage capacitor 112 with image data received at data line 122.

Additionally, in the depicted embodiment, the gate of the driver TFT 116 is electrically coupled to the storage capacitor 112. As such, voltage of the storage capacitor 112 may control operation of the driver TFT 116. More specifically, in some embodiments, the driver TFT 116 may be operated in an active region to control magnitude of supply current flowing through the diode 114 (e.g., from a power supply providing supply voltage $V_{DD}$ 124). In other words, as gate voltage (e.g., storage capacitor 112 voltage) increases above a threshold voltage, the driver TFT 116 may increase the amount of its channel available to conduct electrical current, thereby increasing supply current flowing to the diode 114. On the other hand, as the gate voltage decreases while still being above the threshold voltage, the driver TFT 116 may decrease the amount of its channel available to conduct electrical current, thereby decreasing supply current flowing to the diode 114. The luminance of the diode 114 is dependent on the amount of current flowing through the diode 114. In this manner, the luminance of the pixel 64 may be controlled and, when similar techniques are applied across the display 18 (e.g., to the pixels 64 of the display 18), an image may be displayed.

Current Sensing Across a Diode without User Detection

Operational variations in pixels 64 may be compensated for based on measurements (e.g., current measurements) taken at the TFTs (e.g., at the driver TFT 116). In particular, it may be desired for the diode 114 to emit a target luminance (e.g., as part of accurately producing the image data 54). The target luminance may be emitted by providing a target current across or through the diode 114, and the current across or through the TFT 116 may relate to the current across the diode 114. Moreover, it may be predetermined (e.g., at a manufacturing facility of the electronic display 18 and prior to shipping the display 18 to customers) that supplying a certain data or gate-to-source ($V_{GS}$) voltage at the driver TFT 116 yields a certain current across the diode 114. A curve or equation may be derived to represent this current-voltage (I-V) relationship between various target currents across the driver TFT 116 and their respective data voltages (and stored in, for example, a lookup table in the local memory 14 and/or the main memory storage device 16). However, certain operational variations, such as temperature and age of the display 18, may change the behavior of the display 18 and respective pixels 64, such that the present current-voltage relationship (at the present temperature and present age of the pixel 64 in the electronic display 18) deviates from the predetermined current-voltage relationship.

Sensing at the driver TFT 116 may come with certain drawbacks. In particular, TFTs may exhibit hysteresis (e.g., a lag between TFT behavior that is due to a present input and a past input affecting operation) as a data voltage is applied with respect to the resulting current across the TFT. That is, as or after a data voltage is applied to the driver TFT 116 of the pixel 64, the driver TFT 116 may exhibit a transient state such that the current across the driver TFT 116 to be sensed has not reached a steady state (e.g., which may result in inaccurate current measurements).

The diode 114 may not exhibit hysteresis to the extent of a TFT. Additionally, in certain electronic devices 10, spatial variation of behavior of the TFTs may be greater than spatial variation of behavior of the OLED diodes 114. Thus, sensing current across the diode 114 may result in more accurate measurements in comparison to sensing current across TFTs (such as the driver TFT 116).

However, applying certain voltages (sufficiently high voltages or voltages at sufficiently high temperatures) to determine a target voltage that results in the target current across the diode 114 may cause the diode 114 to emit a luminance that is visible to a user's eye, which may be undesirable. That is, the manufacturer or electronic device provider may desire that such display calibration be kept "invisible", such that the user does not perceive this calibration is being performed. Moreover, attempting to determine the target current across the diode 114 by varying the voltage to the driver TFT 116 (e.g., in discrete steps) may start at a low voltage extreme (e.g., at 0 Volts) and use small stepwise voltage increases to avoid overshooting the target current and causing the diode 114 to emit light, which may be tedious, inefficient, and take an excessive amount of time to perform (e.g., on the scale of hours).

As such, the presently disclosed systems and methods determine a target voltage that, when applied to the driver TFT 116 of the pixel 64 via the data line 122, causes a target current across the diode 114, which results in a target luminance being emitted by the diode 114. A predetermined current-voltage curve or relationship may be determined at an initial temperature and age (e.g., initial conditions) of the pixel 64 (e.g., at a manufacturing facility of the display 18). A first test voltage may be determined that, when applied to the driver TFT 116, generates a first test current across the diode 114 that does not cause the diode 114 to emit light (e.g., such that the diode 114 is dark or light from the diode 114 is not visible to or detectable by a user). In particular, the first test voltage may be a data voltage (e.g., a gate-to-source voltage) that is applied to the driver TFT 116. For example, the first test voltage may be the target voltage divided by 2.5. The first test voltage may then be applied to the driver TFT 116, and the first test current may be sensed across the diode 114 (e.g., using a current sensor).

Based on the predetermined current-voltage curve, a first predetermined current may be determined that corresponds to the current that would result if the first test voltage was applied to the driver TFT 116 under the initial temperature and age of the pixel 64. The first test current is then compared to the first predetermined current. If the first test current is equal to the first predetermined current, then the operational conditions (e.g., temperature and/or aging) of the pixel 64 are approximately the same as the initial conditions, and a predetermined target voltage that caused the target current to be supplied to the diode 114 under the initial conditions may be applied to the driver TFT 116 to result in approximately same target current to the diode 114.

If the first test current is less than the first predetermined current, such as when the present temperature is lower than the initial temperature, a first (e.g., lower temperature) process loop is performed. A ratio of a difference between the first test current and the first predetermined current and a difference between the target current and the first predetermined current may be determined, and the ratio may be applied to the target voltage to determine a second test voltage. Because the first test current associated with the first test voltage at the present operating conditions is less than the first predetermined current associated with the same first test voltage at the initial operating conditions, a second test current may be determined by applying the second test voltage to the driver TFT 116 and sensing the current across the diode 114 may be less than the target current, thus not causing the diode 114 to emit light when applied to the driver TFT 116. The second test current may then be compared to the target current, and, if the second test current is not approximately equal to the target current, then the lower temperature process loop is repeated. If the second test current is approximately equal to the target current, then the second test voltage may be applied to the driver TFT 116 to approximately provide the target current to the diode 114.

If the first test current is greater than the first predetermined current, such as when the present temperature is higher than the initial temperature, a second (e.g., higher temperature) process loop is performed. The ratio of the difference between the first test current and the first predetermined current and the difference between the target current and the first predetermined current may be determined, and the ratio may be applied to the target voltage to determine a ratio voltage. Because the first test current associated with the first test voltage at the present operating conditions is greater than the first predetermined current associated with the same first test voltage at the initial operating conditions, applying the ratio voltage at the driver TFT 116 may cause the diode 114 to emit light. As such, a second test voltage may be determined that is less than the ratio voltage, such as by averaging the first test voltage with the ratio voltage. A second test current may then be determined by applying the second test voltage to the driver TFT 116 and sensing the current across the diode 114. The second test current may then be compared to the target current, and, if the second test current is not approximately equal to the target current, then the higher temperature process loop is repeated. If the second test current is approximately equal to the target current, then the second test voltage may be applied to the driver TFT 116 to approximately provide the target current to the diode 114. In this manner, operational variations, such as temperature and/or aging, of the pixels 64 of the display 18 may be compensated for, and images may be output by the display 18 that are more accurate and true to the input image data 54.

Figure 10:
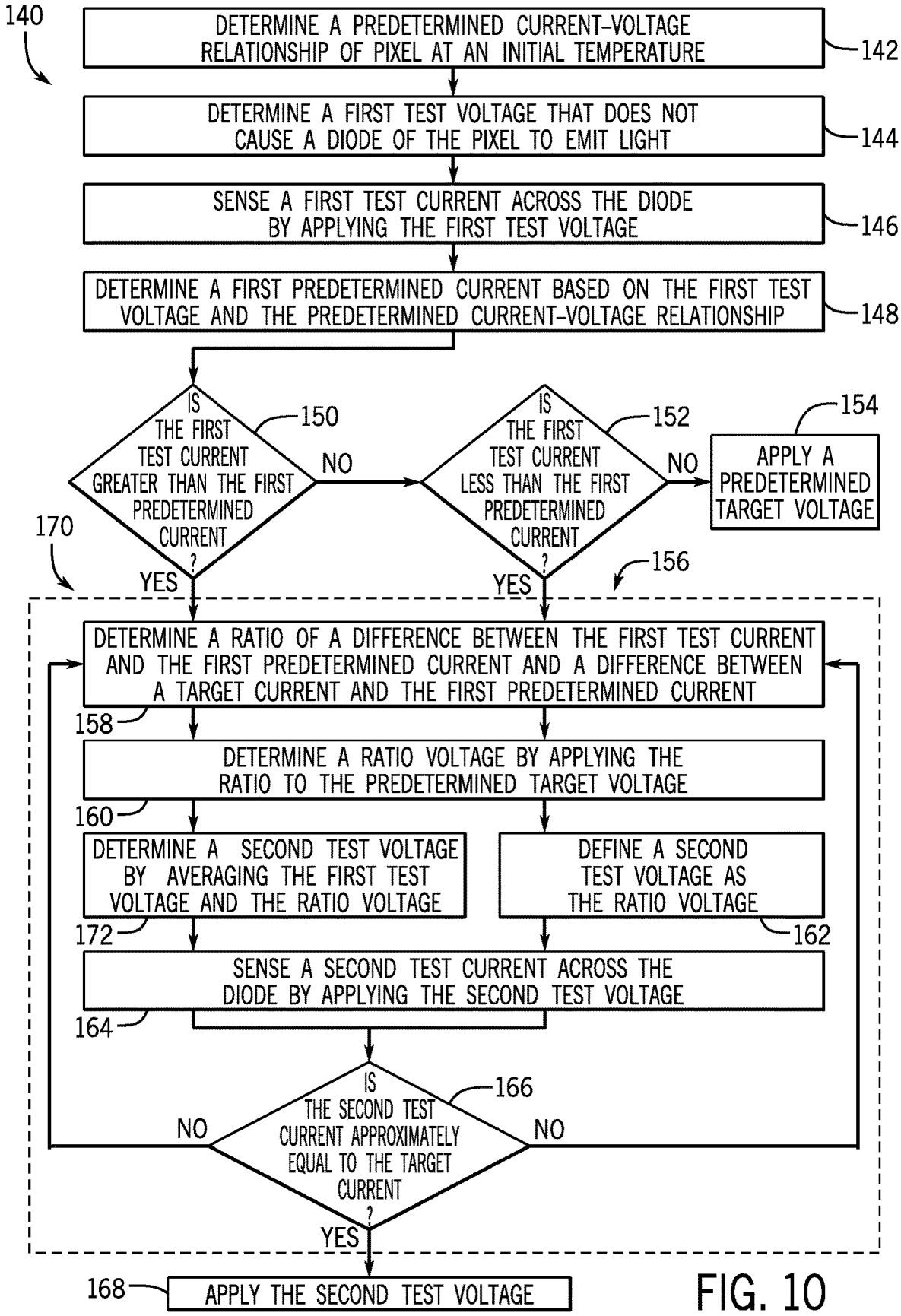
FIG. 10 is process for compensating for operational variations (e.g., temperature variation or aging) of the display of the electronic device of FIG. 1 using current sensing across diodes of pixels of the display without user detection, according to embodiments of the present disclosure.

FIG. 10 is process 140 for compensating for operational variations (e.g., temperature variation or aging) of the display 18 of the electronic device 10 of FIG. 1 using current sensing across the diodes 114 of the pixels 64 of the display 18 without user detection, according to embodiments of the present disclosure. In particular, the process 140 may determine a target voltage that, when applied to a driver TFT 116 of a respective pixel 64 via the data line 122, causes a target current across a diode 114 of the respective pixel 64, which results in a target or desired luminance being emitted by the diode 114.

The process 140 may be repeated for multiple pixels 64 to determine multiple target voltages to be applied at respective driver TFTs 116 of the multiple pixels 64 to compensate for operational variations of each of the multiple pixels 64. While the process 140 is described using steps in a specific sequence, it should be understood that the present disclosure contemplates that the describe steps may be performed in different sequences than the sequence illustrated, and certain described steps may be skipped or not performed altogether. In some embodiments, at least some of the process 140 may be implemented externally (e.g., with respect to the display 18) by executing instructions stored in a tangible, non-transitory, computer-readable medium, such as the local memory 14 and/or the main memory storage device 16, using a processor, such as the processor core complex 12, and, in particular, the image correction circuitry 52 and/or the aging/temperature determination circuitry 56 of the processor core complex 12 shown in FIG. 7. In alternative or additional embodiments, at least some of the process 140 may be implemented internally by the display 18, and, in particular, by the driver-integrated circuit 60 of the display 18.

Figure 11:
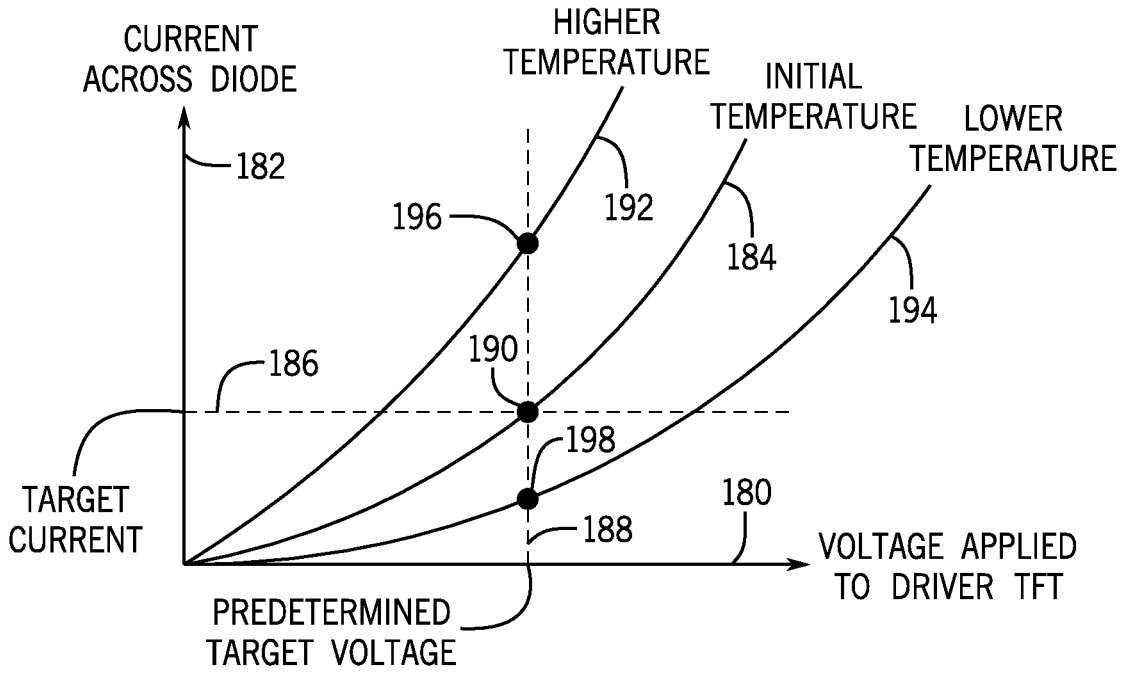
FIG. 11 is a plot of current-voltage relationships of the pixel of FIG. 9, according to embodiments of the present disclosures.

As illustrated, in process block 142, the driver-integrated circuit 60 determines or receives a predetermined current-voltage curve or relationship of the display 18 at an initial temperature and age. For example, the driver-integrated circuit 60 may determine the predetermined current-voltage relationship at a manufacturing facility of the display 18 at a controlled temperature when the display 18 is at an age of 0. The processor core complex 12 may determine the predetermined current-voltage relationship by applying multiple voltages to the driver TFT 116 of the pixel 64 via the data line 122 and sensing the resulting currents across the diode 114. For example, FIG. 11 is a plot of current-voltage relationships of the pixel 64 of FIG. 9 of the display 18 of the electronic device 10 at different temperatures, according to embodiments of the present disclosures. Each plotted relationship relates a voltage 180 applied to the driver TFT 116 to the resulting current 182 across the diode 114. A predetermined current-voltage relationship 184 is illustrated, which may have been determined at a certain temperature (e.g., an initial temperature). The predetermined current-voltage relationship 184 may be saved or stored in, for example, a lookup table in the local memory 14 and/or the main memory storage device 16. The initial temperature at which the predetermined current-voltage relationship 184 was determined may be any suitable temperature, though the temperature may be controlled as to remain uniform while applying multiple voltages to the driver TFT 116 and sensing the resulting currents across the diode 114. For example, the temperature may be 25 degrees Celsius.

The plot of FIG. 11 also illustrates a target current 186, which provided across the diode 114, results in a target luminance to be emitted by the diode 114. The target luminance may correspond to a desired luminance to be emitted by the diode 114 of the pixel 64 to properly display image data 54 input to the pixel 64. At the initial temperature and the initial age of the pixel 64, the voltage to be applied to the driver TFT 116 to result in the target current 186 across the diode 114 is a predetermined target voltage 188. This data point 190 of the predetermined target voltage 188 and the target current 186 is shown on the predetermined current-voltage relationship or curve 184. However, as operational variations (e.g., different temperatures or aging) affect the pixel 64, the voltage to be applied to the driver TFT 116 to result in the target current 186 may change.

Turning back to FIG. 10, in process block 144, the driver-integrated circuit 60 determines a first test voltage that, when applied to the driver TFT 116, generates a first test current across the diode 114, but does not cause the diode 114 to emit light (e.g., such that light from the diode 114 is not visible to or detectable by a user). In particular, the target current 186 may also serve as an emission threshold current of the diode 114, such that if the current across the diode 114 is greater than the target current 186, then the diode 114 may emit light that is visible to the user. However, if the current across the diode 114 is less than the target current 186, then the diode 114 may not emit light and is thus "invisible" to the user. For example, as shown by FIG. 11, if the current across the diode 114 is above the dashed line defined by the target current 186, then the diode 114 may emit light. If the current across the diode 114 is below the dashed line defined by the target current 186, then the diode 114 may not emit light.

As such, the driver-integrated circuit 60 may determine the first test voltage by decreasing the target voltage by any suitable amount, or divide the target voltage by any suitable divisor (for example, a divisor between 2 and 10), as long as applying the first test voltage at the driver TFT 116 does not cause the diode 114 to emit light (e.g., regardless of the present temperature and age of the pixel 64). This is because if the first test voltage is chosen arbitrarily, then, at least at higher temperatures, applying the first test voltage may result in causing the diode 114 to emit light. As an illustrative example, the plot of FIG. 11 includes a higher temperature current-voltage relationship 192 and a lower temperature current-voltage relationship 194. The higher temperature current-voltage relationship 192 may have been determined at a temperature higher than the initial temperature, while the lower temperature current-voltage relationship 194 may have been determined at a temperature lower than the initial temperature. For example, if the initial temperature is 25 degrees Celsius, the higher temperature may be 40 degrees Celsius and the lower temperature may be 10 degrees Celsius. If the first test voltage is arbitrarily chosen to be, for example, the predetermined target voltage 188, then, at the higher temperature, the resulting current (as illustrated by the data point 196) will be greater than the target current 186, and thus the diode 114 may emit light. (However, at the lower temperature, the resulting current (as illustrated by the data point 198) will be less than the target current 186, and thus the diode 114 may not emit light.)

Figure 12:
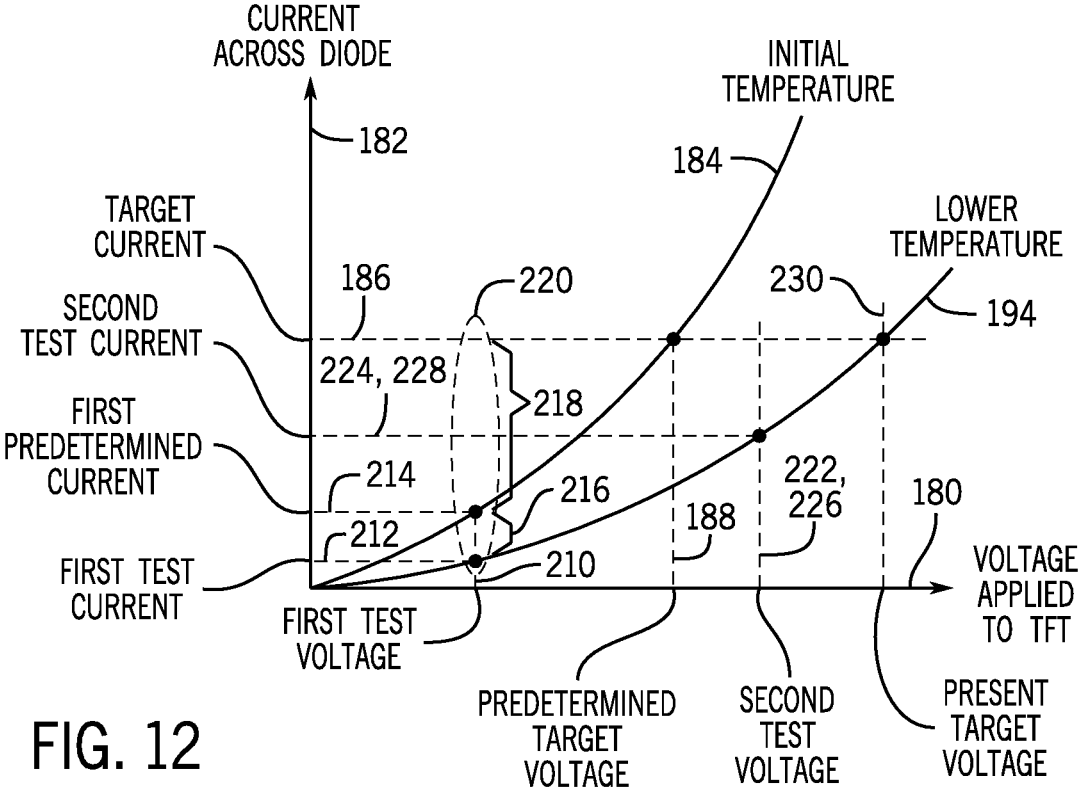
FIG. 12 is a plot of current-voltage relationships of the pixel of FIG. 9 at initial and lower temperatures of FIG. 11, according to embodiments of the present disclosures.
Figure 13:
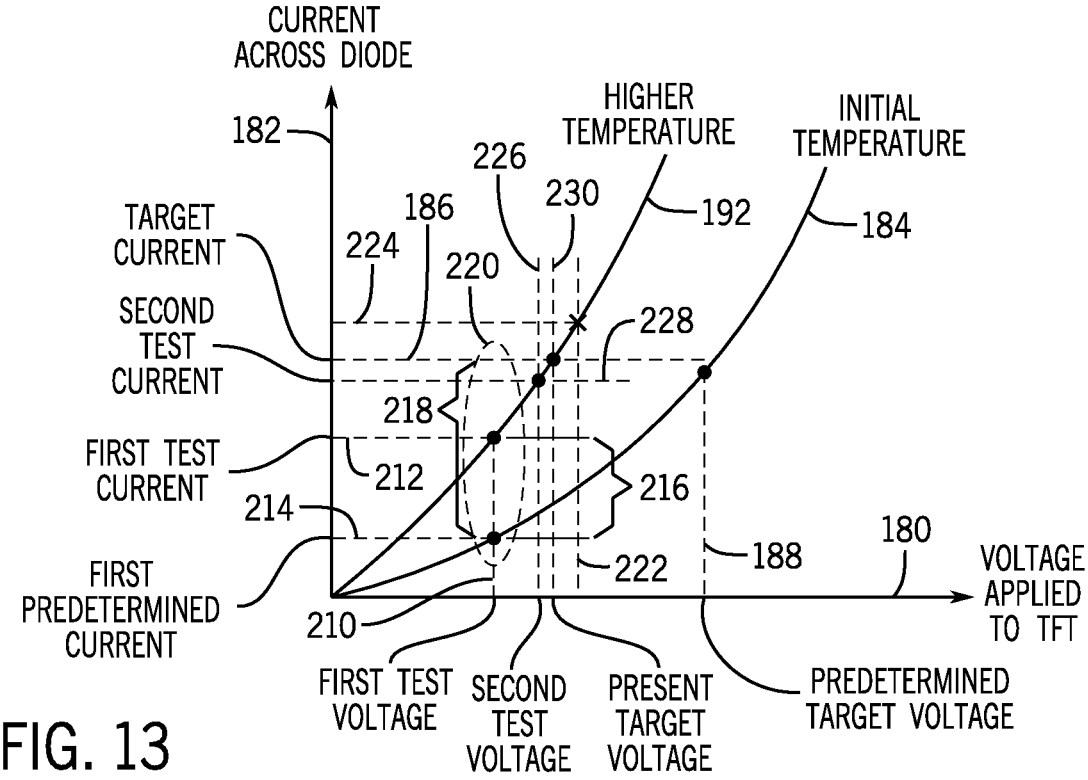
FIG. 13 is a plot of current-voltage relationships of the pixel of FIG. 9 at initial and higher temperatures of FIG. 11, according to embodiments of the present disclosures.

Thus, the driver-integrated circuit 60 may determine the first test voltage by decreasing the target voltage such that applying the first test voltage at the driver TFT 116 does not cause the diode 114 to emit light. For example, the first test voltage may be the target voltage divided by 2.5. As illustrative examples, FIG. 12 is a plot of current-voltage relationships 184, 194 of the pixel 64 of FIG. 9 at the initial and lower temperatures of FIG. 11, and FIG. 13 is a plot of current-voltage relationships 184, 192 of the pixel 64 of FIG. 9 at the initial and higher temperatures of FIG. 11, according to embodiments of the present disclosures. FIGS. 12 and 13 each illustrate the first test voltage 210 determined by the driver-integrated circuit 60 based on the predetermined target voltage 188, such as by dividing the predetermined target voltage 188 by 2.5.

Turning back to FIG. 10, in process block 146, the driver-integrated circuit 60 senses a first test current across the diode 114 by applying the first test voltage. For example, a current sensor may be coupled to the diode 114, and the driver-integrated circuit 60 may use the current sensor to sense the current across the diode 114. In some embodiments, the current sensor may instead be a voltage sensor, and the driver-integrated circuit 60 may sense the voltage drop across the diode 114 and divide the voltage drop by the resistance of the diode 114 to determine the current across the diode 114. FIGS. 12 and 13 each illustrate the first test current 212 sensed by the driver-integrated circuit 60 when applying the first test voltage 210 to the driver TFT 116. As illustrated, both the first test current 212 of the lower temperature current-voltage relationship 194 and the first test current 212 of the higher temperature current-voltage relationship 194 are less than the target current 186. Because the target current 186 is the emission threshold current of the diode 114, the diode 114 may not emit light that is visible to the user when the first test voltage 210 is applied to the driver TFT 116.

Turning back to FIG. 10, in process block 148, the driver-integrated circuit 60 determines a first predetermined current based on the first test voltage and the predetermined current-voltage relationship. In particular, the driver-integrated circuit 60 may apply the first test voltage to the predetermined current-voltage relationship to determine the first predetermined current. That is, the first predetermined current is produced across the diode 114 at the initial temperature and age of the pixel 64 when applying the first test voltage to the driver TFT 116. FIGS. 12 and 13 each illustrate the first predetermined current 214 determined by the driver-integrated circuit 60 by applying the first test voltage 210 to the predetermined current voltage-relationship 184.

The first test current is then compared to the first predetermined current. Turning back to FIG. 10, in decision block 150, the driver-integrated circuit 60 determines whether the first test current is greater than the first predetermined current. If not, in decision block 152, the driver-integrated circuit 60 determines whether the first test current is less than the first predetermined current. If not, the first test current is approximately equal to the first predetermined current, and the driver-integrated circuit 60 in process block 154, applies the predetermined target voltage to the driver TFT 116 on the data line 122. This is because the operational conditions (e.g., temperature and/or aging) of the pixel 64 are approximately the same as the initial conditions, and a predetermined target voltage that caused the target current to be supplied to the diode 114 under the initial conditions may be applied to the driver TFT 116 to result in approximately same target current to the diode 114. FIG. 11 illustrates the predetermined target voltage 188 that may be supplied to the driver TFT 116 to cause the target current to be supplied to the diode 114.

Turning back to FIG. 10, if the driver-integrated circuit 60 determines that the first test current is less than the first predetermined current (from decision block 152), then the driver-integrated circuit 60 performs a first (e.g., lower temperature) process loop 156. The first test current may be less than the first predetermined current because, for example, the present temperature is lower than the initial temperature. Because lower temperatures are associated with voltages generating lower currents, if the first test current is less than the first predetermined current, then it can be assumed that the present temperature is less than the initial temperature. For example, FIG. 12 illustrates the first test current 212 less than the first predetermined current 214, and, as such, the driver-integrated circuit 60 may determine that the present temperature is less than the initial temperature.

As part of the lower temperature process loop 156, in process block 158, the driver-integrated circuit 60 determines a ratio of a difference between the first test current and the first predetermined current and a difference between the target current and the first predetermined current, and the ratio may be applied to the target voltage to determine a second test voltage. As such, the ratio represents the proportion of the first test current to the target current (with respect to the first predetermined current). For example, FIG. 12 illustrates the difference 216 between the first test current 212 and the first predetermined current 214, the difference 218 between the target current 186 and the first predetermined current 214, and an indication of the ratio 220 between the two differences 216, 218.

Turning back to FIG. 10, in process block 160, the driver-integrated circuit 60 determines a ratio voltage by applying the ratio to the predetermined target voltage. The ratio voltage, then, may correspond to a voltage difference from the predetermined target voltage that is proportional to the current difference between the first test current and the first predetermined current. For example, FIG. 12 illustrates the ratio voltage 222 determined by the driver-integrated circuit 60 by applying the ratio 220 to the predetermined target voltage 188.

Turning back to FIG. 10, in process block 162, the driver-integrated circuit 60 defines a second test voltage as the ratio voltage. That is, because applying the ratio voltage at the lower temperature associated with the lower temperature current-voltage relationship 194 may result in the diode 114 not emitting light, the driver-integrated circuit 60 may apply the ratio voltage as the second test voltage (e.g., to sense a resulting current across the diode 114). For example, FIG. 12 illustrates the second test voltage 226 as the ratio voltage 222 in the lower temperature case, and that applying the ratio voltage 222 may result in a ratio current 224 across the diode 114 that does not cause the diode 114 to emit light, since the ratio current 224 is less than the target or emission threshold current 186 due to the lower current values of the lower temperature current-voltage relationship 194 compared to the predetermined current voltage-relationship 184.

Turning back to FIG. 10, in process block 164, the driver-integrated circuit 60 senses a second test current across the diode 114 by applying the second test voltage. For example, FIG. 12 illustrates the second test current 228 sensed by the driver-integrated circuit 60 when applying the second test voltage 226 to the driver TFT 116. As illustrated, the second test current 228 of the lower temperature current-voltage relationship 194 is less than the target current 186. Because the target current 186 is the emission threshold current of the diode 114, the diode 114 may not emit light that is visible to a user.

Turning back to FIG. 10, in decision block 166, the driver-integrated circuit 60 determines whether the second test current is approximately equal to the target current. In particular, the driver-integrated circuit 60 may determine whether the second test current is within a threshold range of the target current. For example, the driver-integrated circuit 60 may determine whether the second test current is within 0.01-15%, 0.025-10%, or 0.05%-1% of the target current. In one embodiment, the driver-integrated circuit 60 may determine whether the second test current is within 0.05% of the target current.

If the driver-integrated circuit 60 determines that the second test current is not approximately equal to the target current, then the driver-integrated circuit 60 may repeat the lower temperature process loop 156 (e.g., until the driver-integrated circuit 60 determines that the second test current is approximately equal to the target current). For example, FIG. 12 illustrates the second test current 228 not approximately equal to the target current 186. Thus, in this example, the driver-integrated circuit 60 may repeat the lower temperature process loop 156. This way, the second test voltage is not applied to the driver TFT 116 to generate a second test current that is not sufficiently close to the target current, avoiding the diode 114 emitting light that is not sufficiently close to the target luminance.

Turning back to FIG. 10, if, however, the driver-integrated circuit 60 determines that the second test current is approximately equal to the target current, then, in process block 168, the driver-integrated circuit 60 applies the second test voltage to the driver TFT 116 on the data line 122. Applying the second test voltage may result in supplying the second test current, which is approximately equal to the target current, to the diode 114, causing the diode 114 to emit light having a luminance approximately equal to the target luminance.

If, in decision block 150, the driver-integrated circuit 60 determines that the first test current is greater than the first predetermined current, then the driver-integrated circuit 60 performs a second (e.g., higher temperature) process loop 170. The first test current may be greater than the first predetermined current because, for example, the present temperature is greater than the initial temperature. Because higher temperatures are associated with voltages generating higher currents, if the first test current is greater than the first predetermined current, then it can be assumed that the present temperature is greater than the initial temperature. For example, FIG. 12 illustrates the first test current 212 greater than the first predetermined current 214, and, as such, the driver-integrated circuit 60 may determine that the present temperature is greater than the initial temperature.

As part of the higher temperature process loop 170, in process block 158, the driver-integrated circuit 60 determines a ratio of a difference between the first test current and the first predetermined current and a difference between the target current and the first predetermined current, and the ratio may be applied to the target voltage to determine a second test voltage. As such, the ratio represents the proportion of the first test current to the target current (with respect to the first predetermined current). For example, FIG. 13 illustrates the difference 216 between the first test current 212 and the first predetermined current 214, the difference 218 between the target current 186 and the first predetermined current 214, and an indication of the ratio 220 between the two differences 216, 218.

Turning back to FIG. 10, in process block 160, the driver-integrated circuit 60 determines a ratio voltage by applying the ratio to the predetermined target voltage. The ratio voltage, then, may correspond to a voltage difference from the predetermined target voltage that is proportional to the current difference between the first test current and the first predetermined current. For example, FIG. 13 illustrates the ratio voltage 222 determined by the driver-integrated circuit 60 by applying the ratio 220 to the predetermined target voltage 188.

Turning back to FIG. 10, in process block 172, the driver-integrated circuit 60 determines a second test voltage by averaging the first test voltage and the ratio voltage. This is done because, as illustrated in FIG. 13, applying the ratio voltage 222 at the higher temperature associated with the higher temperature current-voltage relationship 192 may result in a ratio current 224 across the diode 114 that causes the diode 114 to emit light, since it is greater than the target or emission threshold current 186 due to the higher current values of the higher temperature current-voltage relationship 192 compared to the predetermined current voltage-relationship 184. As such, the driver-integrated circuit 60 may determine a second test voltage that is less than the ratio voltage to avoid light emission light when applying the second test voltage. In particular, the driver-integrated circuit 60 determines the second test voltage by averaging the first test voltage (which was determined in process block 144 to not result in light emission) and the ratio voltage. FIG. 13 illustrates the second test voltage 226 as the average of the first test voltage 210 and the ratio voltage 222 in the higher temperature case. As shown, when the second test voltage 226 is applied to the driver TFT 116, the resulting current 228 is less than the target or emission threshold current 186, and thus may not cause the diode 114 to emit light. While the driver-integrated circuit 60 averages the first test voltage 210 and the ratio voltage 222 to determine the second test voltage 226, any suitable technique is contemplated that determines a second test voltage, different from the first test voltage 210, that also does not cause the diode 114 to emit light.

Turning back to FIG. 10, in process block 164, the driver-integrated circuit 60 senses a second test current across the diode 114 by applying the second test voltage. For example, FIG. 13 illustrates the second test current 228 sensed by the driver-integrated circuit 60 when applying the second test voltage 226 to the driver TFT 116. As illustrated, the second test current 228 of the higher temperature current-voltage relationship 192 is less than the target current 186. Because the target current 186 is the emission threshold current of the diode 114, the diode 114 may not emit light that is visible to a user.

Turning back to FIG. 10, in decision block 166, the driver-integrated circuit 60 determines whether the second test current is approximately equal to the target current. In particular, the driver-integrated circuit 60 may determine whether the second test current is within a threshold range of the target current. For example, the driver-integrated circuit 60 may determine whether the second test current is within 0.01-15%, 0.025-10%, or 0.05%-1% of the target current. In one embodiment, the driver-integrated circuit 60 may determine whether the second test current is within 0.05% of the target current.

If the driver-integrated circuit 60 determines that the second test current is not approximately equal to the target current, then the driver-integrated circuit 60 may repeat the higher temperature process loop 170 (e.g., until the driver-integrated circuit 60 determines that the second test current is approximately equal to the target current). This way, the second test voltage is not applied to the driver TFT 116 to generate a second test current that is not sufficiently close to the target current, avoiding the diode 114 emitting light that is not sufficiently close to the target luminance.

If, however, the driver-integrated circuit 60 determines that the second test current is approximately equal to the target current, then, in process block 168, the driver-integrated circuit 60 applies the second test voltage to the driver TFT 116 on the data line 122. For example, FIG. 13 illustrates the second test current 228 approximately equal to the target current 186. Thus, in this example, the driver-integrated circuit 60 may exit the higher temperature process loop 170 and apply the second test voltage 226 to the driver TFT 116. Applying the second test voltage may result in supplying the second test current, which is approximately equal to the target current, to the diode 114, causing the diode 114 to emit light having a luminance approximately equal to the target luminance. In this manner, the process 140 may compensate for operational variations, such as temperature and/or aging, of the pixels 64 of the display 18, and images may be output by the display 18 that are more accurate and true to the input image data 54.

Even though FIG. 10 illustrates certain process or decision blocks (e.g., process blocks 158, 160, 164 and decision block 166 as being shared by both the lower temperature and higher temperature process loops 156, 170, it should be understood that FIG. 10 is intended to illustrate that once the driver-integrated circuit 60 enters one of the process loops the driver-integrated circuit 60 does not exit that one process loop (and thus enter the other process loop) until after the driver-integrated circuit 60 completes that one process loop (e.g., once the driver-integrated circuit 60 determines that the second test current is approximately equal to the target current in decision block 166).

Mitigating Temperature Variation when Current Sensing Across a Diode

The relationship between the voltage applied to the driver TFT 116 of a pixel 64 and the resulting current across the diode 114 may vary as temperature varies. As such, determining the current-voltage relationship (e.g., by applying test voltages to the driver TFT 116 and sensing the resulting current across the diode 114) when the temperature is more stable may more accurately sense a current-voltage relationship at the diode 114, and thus more accurately compensate for changes in operational conditions of the pixel 64.

Figure 14:
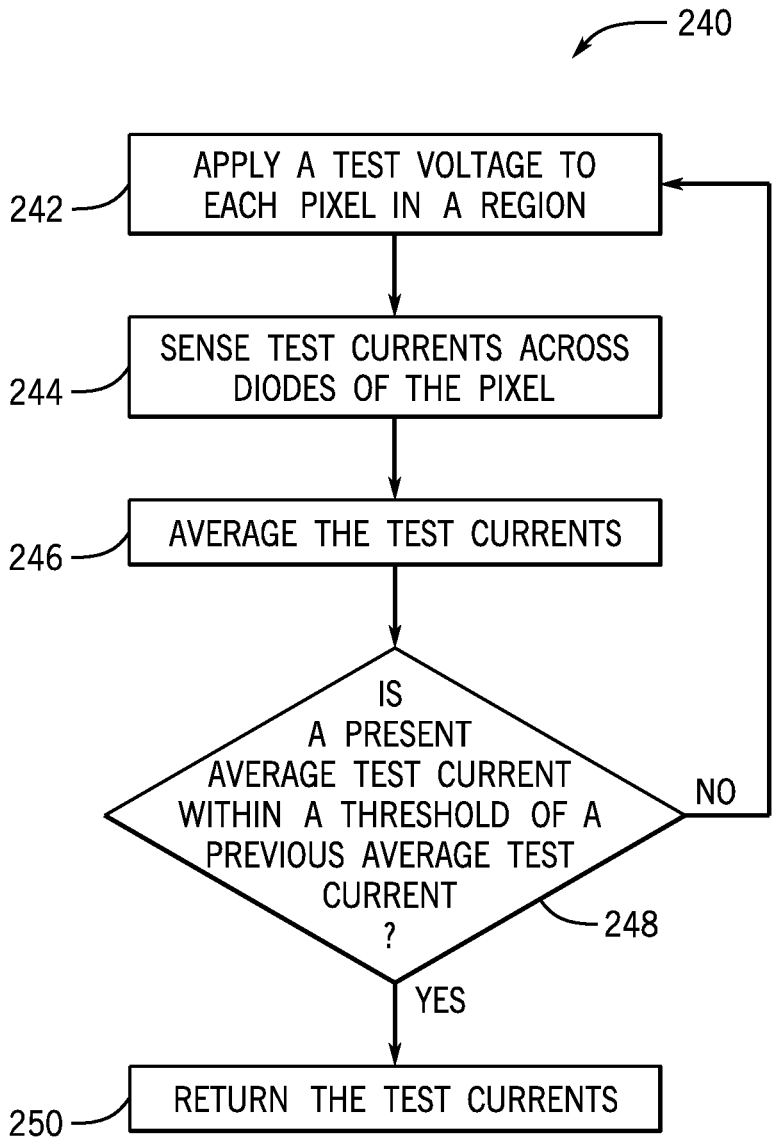
FIG. 14 is process for mitigating temperature variation when current sensing across a diode of the display of the electronic device of FIG. 1, according to embodiments of the present disclosure.

FIG. 14 is process 240 for mitigating temperature variation when current sensing across a diode 114 of the display 18 of the electronic device 10 of FIG. 1, according to embodiments of the present disclosure. While the process 240 is described using steps in a specific sequence, it should be understood that the present disclosure contemplates that the describe steps may be performed in different sequences than the sequence illustrated, and certain described steps may be skipped or not performed altogether. In some embodiments, at least some of the process 240 may be implemented externally (e.g., with respect to the display 18) by executing instructions stored in a tangible, non-transitory, computer-readable medium, such as the local memory 14 and/or the main memory storage device 16, using a processor, such as the processor core complex 12, and, in particular, the image correction circuitry 52 and/or the aging/temperature determination circuitry 56 of the processor core complex 12 shown in FIG. 7. In alternative or additional embodiments, at least some of the process 240 may be implemented internally by the display 18, and, in particular, by the driver-integrated circuit 60 of the display 18.

As illustrated, in process block 242, the driver-integrated circuit 60 applies a test voltage to each pixel 64 in a region of pixels 64 of the display 18. In particular, the region of pixels 64 may be any suitable number of pixels 64 that is effective for determining whether a portion of the display 18 is undergoing a temperature gradient. As such, while the region of pixels 64 may be a single pixel 64 or all pixels 64 of the display 18, it may be more accurate and realistic (e.g., due to limited processing power and/or time constraints) to determine temperature variation for a similarly located and adjacent group of pixels 64 that may more accurately describe a temperature gradient. For example, the region of pixels 64 may be an 8 pixel by 8 pixel, 8 pixel by 10 pixel, 10 pixel by 12 pixel, or other suitable matrix of similarly located and/or adjacent group of pixels 64. The driver-integrated circuit 60 may apply the test voltage to each driver TFT 116 of each pixel 64 in the region of pixels 64.

In process block 244, the driver-integrated circuit 60 senses the resulting test currents across the diodes 114 of the pixels 64. For example, a current sensor may be coupled to each diode 114, and the driver-integrated circuit 60 may use the current sensors to sense the test currents across the diodes 114.

In process block 246, the driver-integrated circuit 60 averages the test currents. In decision block 248, the driver-integrated circuit 60 determines whether this present average test current is within a threshold of a previous average test current. If there is no previous average test current, then the driver-integrated circuit 60 may return to process block 242 and determine a new present average test current, wherein the old present average test current becomes the previous average test current, and may then determine whether the new present average test current is within a threshold of the previous average test current. The threshold may be any suitable difference in current that corresponds to an indication of a stable temperature. For example, the threshold may be 0.1-10% of the previous average test current, 0.25-1% of the previous average test current, and so on. In one embodiment, the threshold may be 0.5% of the previous average test current.

If the driver-integrated circuit 60 determines that the present average test current is not within the threshold of the previous average test current, then the temperature was not sufficiently stable when sensing the test currents. As such, the driver-integrated circuit 60 may not return the sensed test currents due to the inaccurate nature of the measurements, and driver-integrated circuit 60 may return to process block 242 and determine a new present average test current. The driver-integrated circuit 60 may determine new present average test currents at any suitable times, such as periodically (e.g., every 0.1 to 10 seconds, every 0.5 to 5 seconds, every 1 second, and so on).

If, however, the driver-integrated circuit 60 determines that the present average test current is within the threshold of the previous average test current, then the temperature was sufficiently stable when sensing the test currents. As such, in process block 250, the driver-integrated circuit 60 may return the sensed test currents. In this manner, the process 240 may mitigate temperature variation when current sensing across a diode 114, resulting in more accurate determinations of current-voltage relationships at the diode 114, and more accurately compensating for changes in operational conditions of the pixel 64.

Adapting TFT Current Sensing for Diode Current Sensing

In some cases, an electronic device 10 may be implemented with a system for TFT current sensing. That is, the system may include a current sensor at the driver TFT 116 (or a voltage sensor that may be used to determine the current based on the resistance of the driver TFT 116), lookup tables that store a current-voltage relationship between voltage applied to the driver TFT 116 and the resulting current across the driver TFT 116, and so on. Rather than implementing completely new standalone diode current sensing system in the electronic device 10, the already present TFT current sensing system may be adapted to implement a diode current sensing system.

Figure 15:
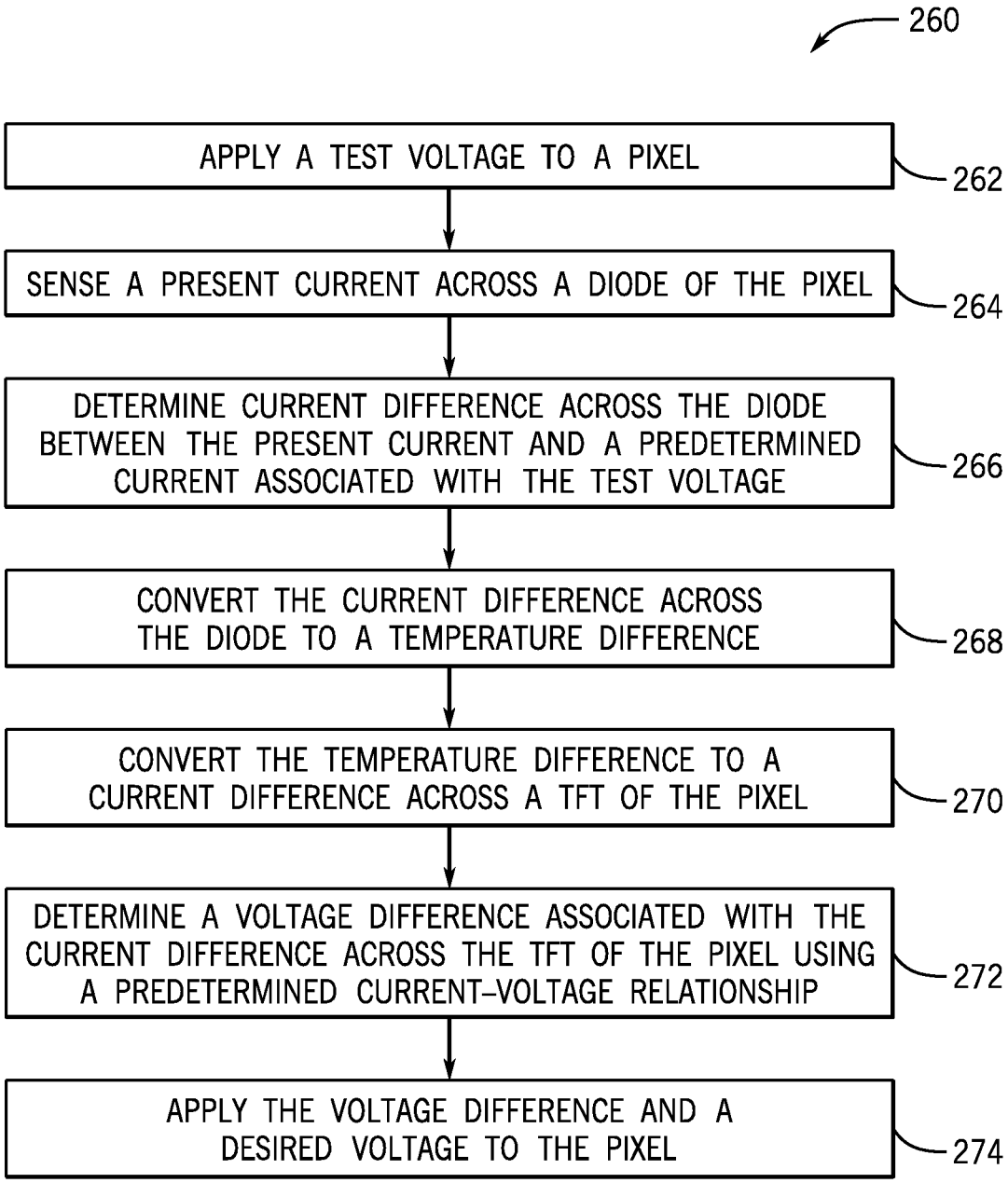
FIG. 15 is process for adapting a transistor current sensing system for a diode current sensing system in the electronic device of FIG. 1, according to embodiments of the present disclosure.

FIG. 15 is process 260 for adapting a TFT current sensing system for a diode current sensing system in the electronic device 10 of FIG. 1, according to embodiments of the present disclosure. While the process 260 is described using steps in a specific sequence, it should be understood that the present disclosure contemplates that the describe steps may be performed in different sequences than the sequence illustrated, and certain described steps may be skipped or not performed altogether. In some embodiments, at least some of the process 260 may be implemented externally (e.g., with respect to the display 18) by executing instructions stored in a tangible, non-transitory, computer-readable medium, such as the local memory 14 and/or the main memory storage device 16, using a processor, such as the processor core complex 12, and, in particular, the image correction circuitry 52 and/or the aging/temperature determination circuitry 56 of the processor core complex 12 shown in FIG. 7. In alternative or additional embodiments, at least some of the process 260 may be implemented internally by the display 18, and, in particular, by the driver-integrated circuit 60 of the display 18.

As illustrated, in process block 262, the driver-integrated circuit 60 applies a test voltage to a pixel 64 of the display 18. In particular, the driver-integrated circuit 60 may apply the test voltage to a driver TFT 116 of the pixel 64. Moreover, according to a predetermined current-voltage relationship, applying the test voltage at certain (e.g., initial) operating conditions may result in a target current being supplied to the diode 114. For example, the predetermined current-voltage relationship may be the predetermined current-voltage relationship 184 illustrated in FIG. 10, the test voltage may be the predetermined target voltage 188, and the target current may be the target current 186. The test voltage may be selected such that it does not cause the diode 114 to emit light when applied to the driver TFT 116.

In process block 264, the driver-integrated circuit 60 senses a present current across the diode 114 of the pixel 64. The present current may be different from the target current due to operational variations or different operating conditions, such as a different temperature from the initial temperature at which the predetermined current-voltage relationship was determined, a different age from the initial age at which the predetermined current-voltage relationship was determined, and so on.

In process block 266, the driver-integrated circuit 60 determines a current difference across the diode 114 between the present current and a predetermined current associated with the test voltage. In particular, the predetermined current may be the target current per the predetermined current-voltage relationship (e.g., illustrated as the target current 186 in FIG. 10).

In process block 268, the driver-integrated circuit 60 converts the current difference across the diode 114 to a temperature difference. In particular, a lookup table may be stored in, for example, the local memory 14 and/or the main memory storage device 16, that defines a relationship between current differences across the diode 114 and temperature differences. The driver-integrated circuit 60 may use this lookup table to convert the current difference across the diode 114 to the temperature difference.

In process block 270, the driver-integrated circuit 60 converts the temperature difference to a current difference across the driver TFT 116. In particular, a lookup table may be stored in, for example, the local memory 14 and/or the main memory storage device 16, that defines a relationship between temperature differences and current differences across the driver TFT 116. The driver-integrated circuit 60 may use this lookup table to convert the temperature difference to the current difference across the driver TFT 116.

In process block 272, the driver-integrated circuit 60 determines a voltage difference associated with the current difference across the driver TFT 116 using a predetermined current-voltage relationship. In particular, a lookup table may be stored in, for example, the local memory 14 and/or the main memory storage device 16, that defines the predetermined current-voltage relationship between voltage differences applied to the driver TFT 116 and current differences across the driver TFT 116. The predetermined current-voltage relationship may have been determined at certain (e.g., initial) operating conditions (e.g., at a manufacturing facility of the display 18), such as at a controlled temperature and at a pixel 64 or display 18 age of 0. The driver-integrated circuit 60 may use this lookup table to determine the voltage difference by applying the current difference to the predetermined current-voltage relationship.

In process block 274, the driver-integrated circuit 60 applies the voltage difference and a desired voltage to the pixel 64. In this manner, the process 260 may adapt a TFT current sensing system to sense current across the diode 114.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A mobile electronic device comprising:

a display comprising a pixel, wherein the pixel comprises:

a diode configured to emit light based on an amount of current through the diode;

a transistor configured to control the amount of current flowing through the diode based on a voltage received; and a driver-integrated circuit configured to:

sense the amount of current through the diode in response to applying a test voltage, wherein the amount of current comprises a nonzero amount;

determine a predetermined current based on the test voltage and a predetermined current-voltage relationship, wherein the pre-determined current-voltage relationship is determined at an initial condition of the diode; and apply a predetermined voltage determined based on a target current and the predetermined current-voltage relationship in response to determining that the amount of current is approximately equal to the predetermined current.

2. The mobile electronic device of claim 1, wherein the diode emits substantially no light while the driver-integrated circuit senses the amount of current through the diode.

3. The mobile electronic device of claim 1, wherein the driver-integrated circuit is configured to:

sense a second amount of current through the diode in response to applying a second test voltage;

determine a second predetermined current based on the second test voltage and the predetermined current-voltage relationship;

determine a ratio based on the second amount of current, a second target current, and the second predetermined current;

sense a test current by applying a second test voltage determined based on the ratio; and apply the second test voltage to the diode in response to determining that the test current is approximately equal to the second target current.

4. The mobile electronic device of claim 3, wherein the second test voltage is determined by applying the ratio to the second test voltage in response to determining that the second amount of current is less than the second predetermined current.

5. The mobile electronic device of claim 3, wherein the second test voltage is determined by applying the ratio to the test voltage to determine a ratio voltage, and averaging the second test voltage and the ratio voltage, in response to determining that the second amount of current is greater than the second predetermined current.

6. The mobile electronic device of claim 3, wherein the driver-integrated circuit is configured to determine that the test current is approximately equal to the second target current if the test current is within a threshold range of the second target current.

7. The mobile electronic device of claim 1, wherein the driver-integrated circuit is configured to prepare image data to send to the pixel and adjust the image data to compensate for operational variations of the display by applying the predetermined voltage.

8. The mobile electronic device of claim 7, wherein the operational variations comprise temperature variation at the pixel, aging of the pixel, or both.

9. The mobile electronic device of claim 8, wherein one or more additional electronic components of the display causes the temperature variation at the pixel.

10. The mobile electronic device of claim 7, wherein applying the predetermined voltage comprises adjusting the image data.

11. A method for determining a target voltage to apply to a transistor of a pixel at a present temperature to cause a current across a diode of the pixel that causes the diode to emit light at a target luminance, wherein the method comprises:

determining a predetermined current-voltage relationship of the pixel at an initial temperature;

determining a first test voltage that does not cause the diode of the pixel to emit light;

sensing a first test current across the diode by applying the first test voltage;

determining a first predetermined current based on the first test voltage and the predetermined current-voltage relationship;

performing a lower temperature process loop in response to determining that the present temperature is less than the initial temperature; and performing a higher temperature process loop in response to determining that the present temperature is greater than the initial temperature.

12. The method of claim 11, wherein performing the lower temperature process loop comprises:

determining a ratio of a difference between the first test current and the first predetermined current and a difference between a target current and the first predetermined current;

sensing a test current by applying a second test voltage determined by applying the ratio to the first test voltage; and applying the second test voltage to the diode in response to determining that the test current is approximately equal to the target current.

13. The method of claim 11, wherein performing the higher temperature process loop comprises:

determining a ratio of a difference between the first test current and the first predetermined current and a difference between a target current and the first predetermined current;

sensing a test current by applying a second test voltage determined by:

determining a ratio voltage by applying the ratio to the first test voltage; and averaging the first test voltage and the ratio voltage; and applying the second test voltage to the diode in response to determining that the test current is approximately equal to the target current.

14. The method of claim 11, comprising applying a predetermined voltage determined based on a target current and the predetermined current-voltage relationship in response to determining that the present temperature is approximately equal to the initial temperature.

15. The method of claim 11, wherein determining that the present temperature is less than the initial temperature comprises determining that the first test current is less than the first predetermined current, and determining that the present temperature is greater than the initial temperature comprises determining that the first test current is greater than the first predetermined current.

16. A display comprising:

a pixel comprising:

a diode configured to emit light based on an amount of current through the diode; and a transistor configured to control the amount of current flowing through the diode based on a voltage received; and a driver-integrated circuit configured to:

sense a first test current across the diode by applying a first test voltage that does not cause the diode of the pixel to emit light;

determine a first predetermined current based on the first test voltage and a predetermined current-voltage relationship determined at an initial temperature;

perform a lower temperature process loop in response to determining that the first test current is less than the first predetermined current; and perform a higher temperature process loop in response to determining that the first test current is greater than the first predetermined current.

17. The display of claim 16, wherein the display comprises a plurality of pixels including the pixel, wherein the driver-integrated circuit is configured to sense the first test current by applying the first test voltage to each transistor of the plurality of pixels, sense a plurality of test currents across each diode of the plurality of pixels, average the plurality of test currents to determine a present average test current, compare the present average test current to a previous average test current, and return the first test current in response to determining that the present average test current is approximately equal to the previous average test current.

18. The display of claim 17, wherein the driver-integrated circuit is configured to not return the first test current in response to determining that the present average test current is not approximately equal to the previous average test current.

19. The display of claim 17, wherein the driver-integrated circuit is configured to determine that the present average test current is approximately equal to the previous average test current if the present average test current is within a threshold range of the previous average test current.

20. The display of claim 16, wherein the driver-integrated circuit is configured to determine the predetermined current-voltage relationship of the pixel at the initial temperature.

* * * * *